US005312275A

United States Patent [19]

Place

[11] Patent Number: 5,312,275

[45] Date of Patent: May 17, 1994

[54] JET BOAT DIVERTER NOZZLE WITH BUILT-IN RIDE PLATE

[76] Inventor: Frank Place, 3107 Sunnywood Dr., Fullerton, Calif. 92635

[21] Appl. No.: 2,810

[22] Filed: Jan. 11, 1993

[51] Int. Cl.[5] ..... B63H 11/00

[52] U.S. Cl. ..... 440/41; 440/47

[58] Field of Search ..... 440/38, 40, 41, 42, 440/47; 239/290, 300, 301, 265.19; 244/110 B; 446/163; 114/151, 274, 283, 288; 60/221, 222, 227

[56] References Cited

U.S. PATENT DOCUMENTS

| | | | |
|---|---|---|---|
| 3,949,700 | 4/1976 | Baroody | 440/41 |
| 4,223,630 | 9/1980 | Keeney | 440/41 |
| 5,049,096 | 9/1991 | Henn | 440/41 |

*Primary Examiner*—Robert J. Oberleitner
*Assistant Examiner*—Clifford T. Bartz
*Attorney, Agent, or Firm*—Edgar W. Averill, Jr.

[57] ABSTRACT

A diverter nozzle assembly for use on jet boats. The diverter nozzle assembly has a nozzle portion with a collar at the nozzle entrance and a reversing chamber at the exit end. The reversing chamber contains the entrance of a reversing nozzle and the exit of the reversing nozzle extends to the bottom of the diverter nozzle assembly. A ride plate a flat planer portion which curves upwardly to the forward edge of the assembly and curves slightly downwardly just before the forward edge of the outlet of the reversing nozzle. The ride plate provides a quicker planing action to the boat and reduces drag.

6 Claims, 3 Drawing Sheets

JET BOAT DIVERTER NOZZLE WITH BUILT-IN RIDE PLATE

BACKGROUND OF THE INVENTION

The field of the invention is boating and the invention relates more particularly to jet boats which are driven by pumping a flow of water through a nozzle at the stern of the boat.

Jet boat nozzles are typically provided with a means for diverting the flow of water from the pump of the jet boat from its normal rearward direction to a slightly forward direction so that the boat may be propelled in reverse. Various patents disclose ways of carrying this out such as U.S. Pat. Nos. 3,945,201; 3,949,700; 3,823,683; and 3,827,390. The reversing nozzle of most of these designs extends below the bottom of the nozzle assembly and can cause drag particularly as the boat is accelerating.

BRIEF SUMMARY OF THE INVENTION

It is an object of the present invention to provide a diverter nozzle assembly which virtually eliminates drag caused by the reverse passage.

The present invention is for a diverter nozzle assembly for use on jet boats. Said diverter nozzle assembly having an entrance end and an exit end. The diverter nozzle assembly comprises a generally cylindrical diverter nozzle having a generally cylindrical inner surface portion, having an inside diameter and an outside surface, and a side wall. The generally cylindrical diverter nozzle has a nozzle entrance end and a nozzle exit end, and the inner surface forms a water stream directing path with a central axis. A collar is formed at the nozzle entrance end which also has a generally cylindrical inner surface and an outer surface, a forward edge, and a nozzle edge. The generally cylindrical collar inner surface has a larger inside diameter than the inside diameter of the generally cylindrical diverter nozzle. The collar includes means for attachment to a jet boat pump outlet. A reversing chamber is positioned at the exit end of the generally cylindrical diverter nozzle and the reversing chamber has an inner surface, an outer surface, a top, a bottom, a right side, and a left side. The inner surface of the reversing chamber extends outwardly from the inner surface of the generally cylindrical diverter nozzle. The reversing chamber has a reversing passage, having an inlet at the inner surface and at the bottom of the reversing chamber and the reversing passage has an outlet at the outer surface of the reversing chamber at the bottom thereof. The intersection of the outlet and the bottom of said reversing chamber forms a reverse passage outlet plane formed at an angle between 4° and 10° with respect to the central axis of the generally cylindrical inner surface portion of the said diverter nozzle. The angle is directed rearwardly and the reverse passage outlet has a forward edge and an exit edge. A ride plate extends from the forward edge of the reversing passage outlet to the forward edge of the collar. The ride plate has a flat planer portion which is generally horizontal when the central axis of the diverter nozzle is horizontal and the flat planer portion curves upwardly to the forward edge of the collar. The flat planer portion also extends rearwardly to a line immediately forward of the forward edge of the reversing passage outlet at which line it curves downwardly to intersect with a forward edge of the reversing passage outlet, whereby the ride plate provides a quicker planning action to the boat to which it is attached and virtually eliminates drag from the reversing nozzle. Preferably, the ride plate also has an upper surface providing a wall thickness and has a right edge and a left edge which are preferably beveled at the bottom. The forward edge of the outlet of the reversing passage is preferably about ⅛th of an inch below the flat planer portion of said ride plate at the line immediately forward of the forward edge of the outlet.

DESCRIPTION OF THE PREFERRED EMBODIMENTS

Figure 1:
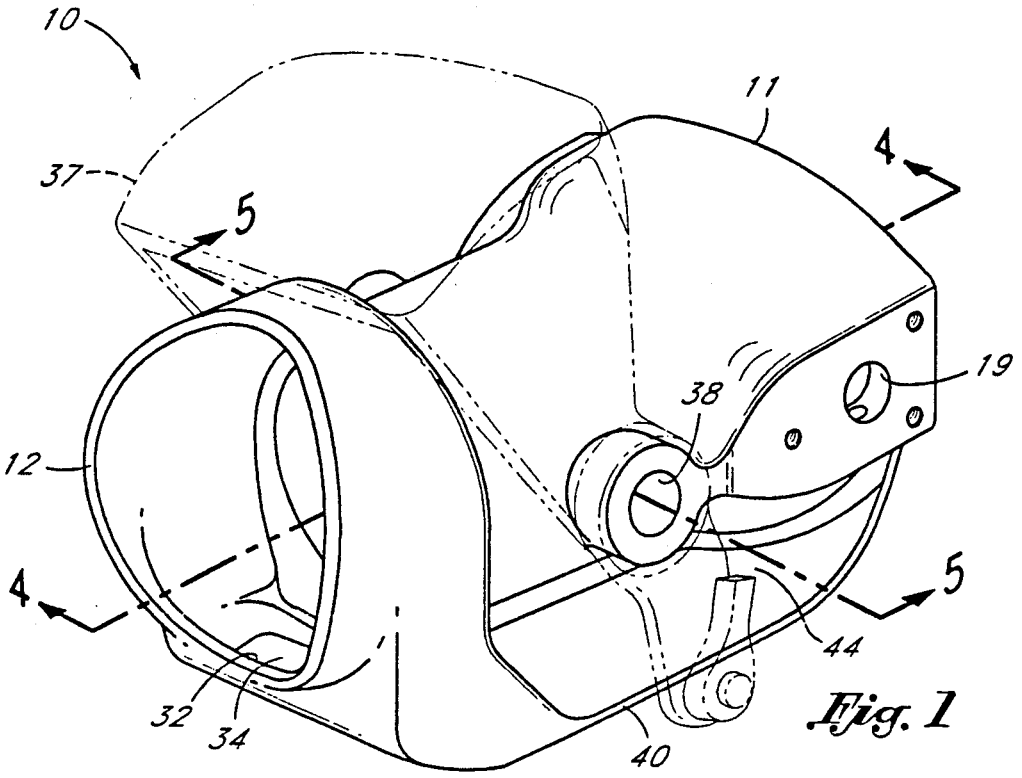
FIG. 1 is a perspective view showing the exit end, top and right side of the jet boat diverter nozzle of the present invention.
Figure 4:
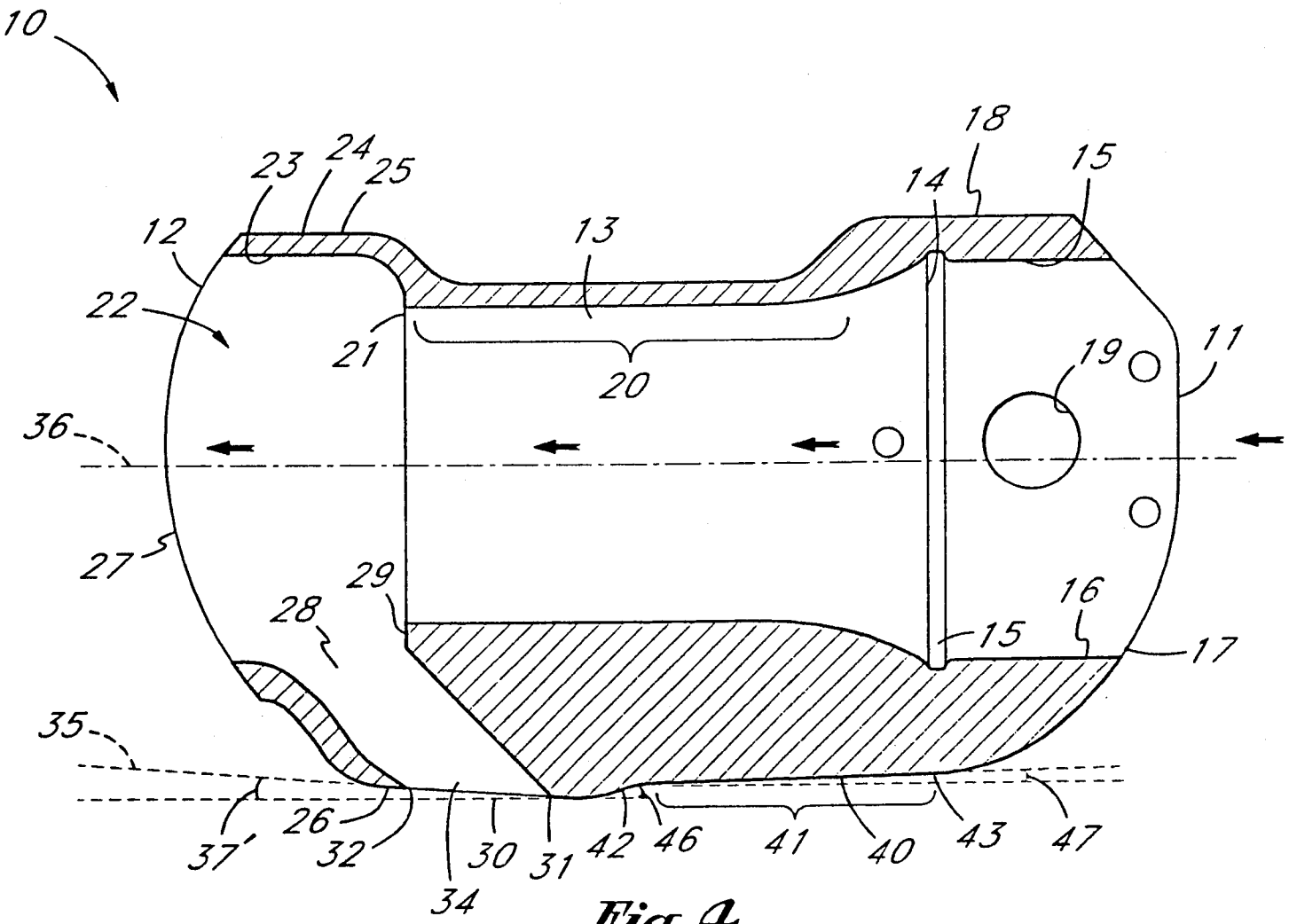
FIG. 4 is a cross-sectional view taken along line 4—4 of FIG. 1.

The jet boat diverter nozzle assembly of the present invention is shown in perspective view in FIG. 1 and indicated generally by reference character 10. Diverter nozzle assembly 10 has an entrance end 11 and an exit end 12. As shown best in FIG. 4, the diverter nozzle assembly 10 has a generally cylindrical diverter nozzle 13 which flares outwardly to its entrance end 14. A collar 15 is located at the entrance end 14 and has an inner surface 16 and a forward edge 17. Collar 15 has an outer surface 18 and is provided with means for attachment to a jet boat pump outlet including a hole 19.

The diverter nozzle 13 has a generally cylindrical portion 20 which extends rearwardly from the flared portion to the exit end 21 at which point it flares outwardly to a reversing chamber 22.

Reversing chamber 22 has an inner surface 23, and outer surface 24, a top 25, a bottom 26, and an exit end 27. A reversing passage 28 extends from bottom 26 into the reversing chamber 22 where it initiates at reverse chamber inlet 29. Reversing passage 28 has a reversing passage outlet 30 which has a forward edge 31, an exit edge 32, a right edge 33, and a left edge 34. Edges 31, 34, 32, and 33 lie in a plane which plane is indicated by reference character 35. This plane is positioned at an angle of about 4° to 10° with respect to the flat planar portion 41 of ride plate 40. This angle is indicated by reference character 37 in FIG. 4.

Figure 2:
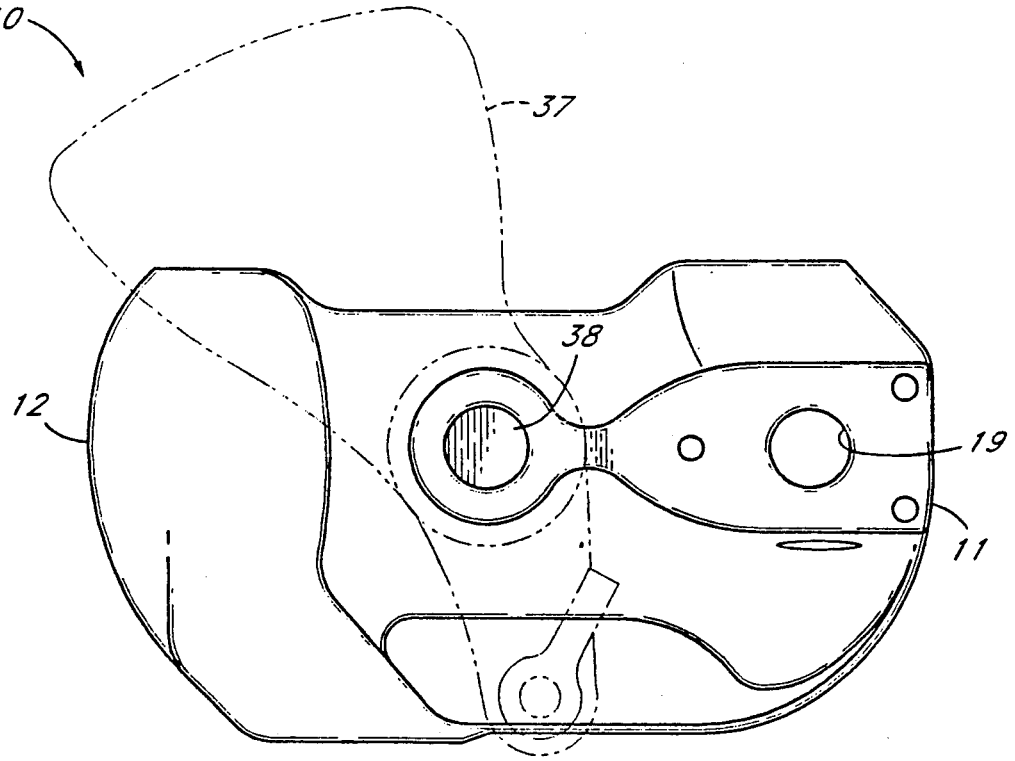
FIG. 2 is a right side view thereof.
Figure 3:
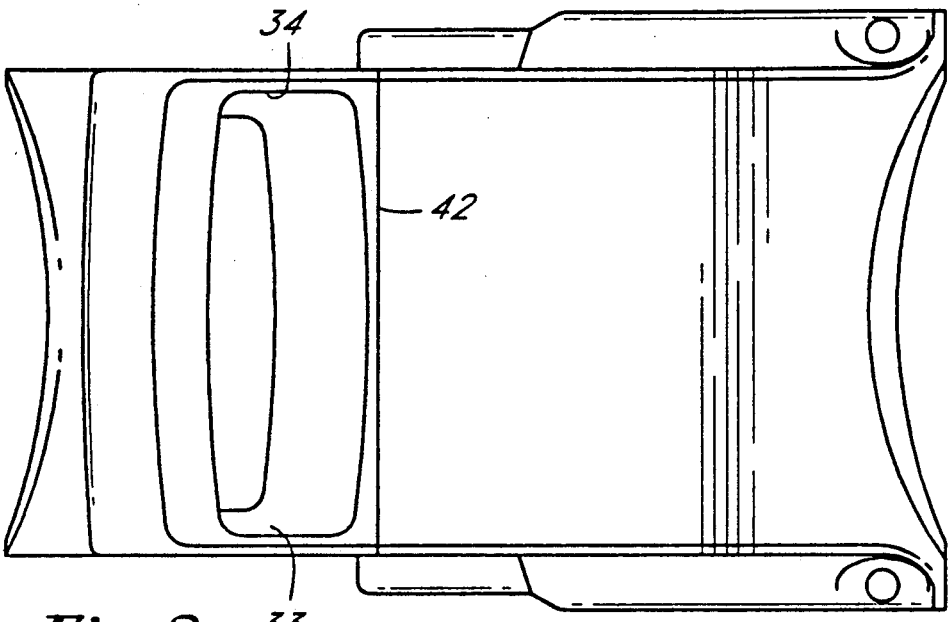
FIG. 3 is a bottom view thereof.
Figure 5:
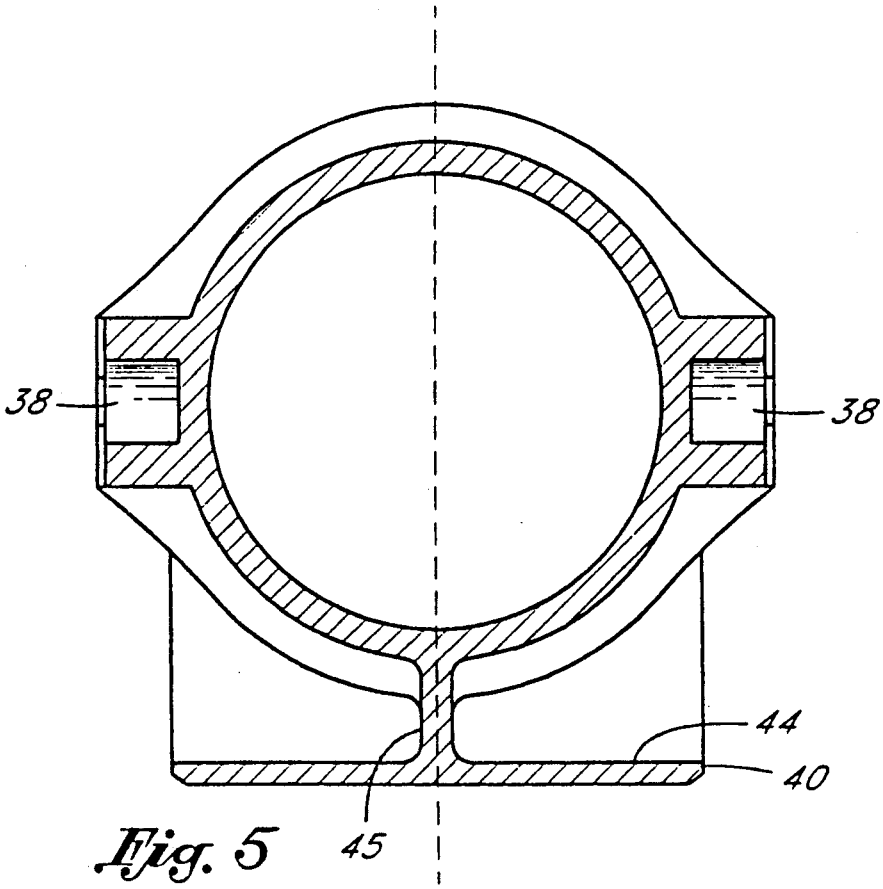
FIG. 5 is a cross-sectional view taken along line 5—5 of FIG. 1.

As shown in FIG. 2, a reversing gate 37 (shown in phantom lines) pivots about a pin held in reversing gate support opening 38. Reversing gate 37 pivots counter clockwise as viewed in FIG. 5 and covers the exit end 27 of the reversing chamber 22, thereby diverting water through reverse passage 28 in a conventional manner.

In the past, the reversing passage outlet has caused substantial drag particularly in the acceleration of the boat from a slow speed to a planning condition. This drag also made it difficult to operate at a low speed and also made it difficult to control the bow attitude of the boat. A ride plate 40 is formed at the bottom of the diverter nozzle assembly. Ride plate 40 has a flat planer portion 41 which extends from a line 42 in a forward direction to a line 43 where it curves smoothly upwardly to forward edge 17 of collar 15. Preferably, the ride plate has an upper surface 44, which extends inwardly to a central web 45 shown best if FIG. 5. Ride plate 40 provides substantial support and control for the bow attitude of the boat from first thrust to high speed. This added control makes water skiing easier for both the skier and the driver and helps keep the bow of the boat low for faster planing and better visibility.

The relative location of the flat planer portion 41 of ride plate 40 and reversing passage outlet 30 forms an important part of the present invention. As shown best in FIG. 4, forward edge 31 of outlet 30 is spaced a distance of about a 3/16 of an inch at line 42 below flat planer portion 41. This distance is indicated by reference character 46. The ride plate is smoothly curved from line 42 to forward edge 31 of outlet 30.

It is also preferable that the planer surface of ride plate 40 be slightly angled so that its position at line 43 is slightly higher than at line 42. This angle should be about 1° to 2° and is indicated by reference character 47 in FIG. 4.

The diverter nozzle assembly of the present invention significantly improved the performance of a jet boat, particularly at first thrust. It is attachable to conventional attachment assemblies of jet boat pump outlets and is controlled in the same manner as conventional nozzles.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A diverter nozzle assembly for use on jet boats, said diverter nozzle assembly having an entrance end and an exit end, said diverter nozzle assembly comprising:

a generally cylindrical diverter nozzle having a generally cylindrical inner surface portion having an inside diameter and an outer surface and a side wall, a nozzle entrance end and a nozzle exit end, said inner surface forming a water stream directing path and said inner surface having a central axis;

a collar at the nozzle entrance end of said generally cylindrical nozzle, said collar having a generally cylindrical inner surface and an outer surface, a forward edge and a nozzle edge, the generally cylindrical collar inner surface having a larger inside diameter than the inside diameter of the generally cylindrical inner surface portion of the diverter nozzle and the collar inner surface communicating with the inner surface of said generally cylindrical diverter nozzle, said collar including means for attachment to a jet boat pump outlet;

a reversing chamber at the exit end of said generally cylindrical diverter nozzle, said reversing chamber having an inner surface, an outer surface, a top, a bottom and a right side and a left side, the inner surface of said reversing chamber extending outwardly from the inner surface of said generally cylindrical diverter nozzle, said reversing chamber having a reversing passage having an inlet at the inner surface and at the bottom of the reversing chamber and said reversing passage having an outlet at the outer surface of the reversing chamber and at the bottom thereof, and said reversing passage outlet having a forward edge and an exit edge; and a ride plate extending from the forward edge of said reversing passage outlet to the forward edge of the collar, said ride plate having a flat portion which is generally horizontal when the central axis of said generally cylindrical portion of said diverter nozzle is horizontal and said flat planar portion curving upwardly to the forward edge of the collar and said flat planar portion extending rearwardly and said ride plate extending to a line of intersection with said forward edge of said reversing passage outlet, whereby the ride plate provides a quicker planing action to the boat to which it is attached and virtually eliminates drag from the reversing passage.

2. The diverter nozzle assembly of claim 1 wherein said flat planar portion of said ride plate has an upper surface below the outer surface of the generally cylindrical diverter nozzle, said flat planer portion having a wall thickness, a right edge and a left edge.

3. The diverter nozzle assembly of claim 2 wherein said upper surface of said flat planar portion extends toward an axially directed central bisecting plane of the diverter nozzle assembly and terminates at a central web below said diverter nozzle.

4. The diverter nozzle assembly of claim 2 wherein said right and left edges of said flat planar portion are beveled at an angle of about 45 degrees.

5. The diverter nozzle assembly of claim 1 wherein the forward edge of said outlet of said reversing passage is about ⅛ of an inch below the flat planar portion of said ride plate at the line immediately forward of the forward edge of the outlet.

6. The diverter nozzle assembly of claim 1 wherein said generally horizontal flat planar portion is angled slightly downwardly from the entrance end toward the exit end and the amount of said angle is from about 1° to about 2°.

* * * * *